United States Patent [19]

Ullmann et al.

[11] 4,195,650

[45] Apr. 1, 1980

[54] CONTAINER FOR STORING OBJECTS

[75] Inventors: Roland Ullmann, Hausen; Otto Schweingruber, Glashütten; Klaus Oprach, Schwalbach, all of Fed. Rep. of Germany

[73] Assignee: Braun Aktiengesellschaft, Frankfurt am Main, Fed. Rep. of Germany

[21] Appl. No.: 902,265

[22] Filed: May 2, 1978

Related U.S. Application Data

[63] Continuation of Ser. No. 838,590, Oct. 3, 1977, abandoned, which is a continuation of Ser. No. 696,295, Jun. 15, 1976, abandoned.

[30] Foreign Application Priority Data

Aug. 25, 1975 [DE] Fed. Rep. of Germany ..... 2537730

[51] Int. Cl.[2] ..... A45D 33/00

[52] U.S. Cl. ..... 132/83 R

[58] Field of Search ..... 132/83; 206/45.23, 37-38

[56] References Cited

U.S. PATENT DOCUMENTS

| | | | |
|---|---|---|---|
| 1,425,138 | 8/1922 | Roystone | 132/83 R |
| 1,866,576 | 7/1932 | Neiman | 132/83 R |
| 3,308,835 | 3/1967 | Silverberg | 132/83 R |

FOREIGN PATENT DOCUMENTS

| | | | |
|---|---|---|---|
| 576289 | 5/1924 | France | 206/45.23 |

*Primary Examiner*—G. E. McNeill

*Attorney, Agent, or Firm*—Michael J. Striker

[57] ABSTRACT

A container for storing objects comprises a pair of spaced container sections and a hinge structure connected between the sections. Each of these sections is pivotably mounted on the hinge structure so that it is turnable in a path through a full 360° revolution about a respective imaginary axis which extends generally in direction transversely of the path. The hinge structure includes a plurality of spur gears, and one of the gears has a set of teeth aligned so as to extend transversely of the path of movement and another of the gears has a different set of teeth which is inclined relative to said first-mentioned set so as to frictionally retain the container sections at any selected position relative to each other in the path. It is preferred if the container is generally box-shaped for storing such objects as electric shavers and other analogous shaving accessories.

5 Claims, 6 Drawing Figures

CONTAINER FOR STORING OBJECTS

This application is a continuation of Ser. No. 838,590, Oct. 3, 1977 now abandoned, which is a continuation of Ser. No. 696,295, June 15, 1976 now abandoned.

BACKGROUND OF THE INVENTION

The present invention relates generally to a container for storing and/or transporting objects and, more particularly, to a container for storing and/or transporting shaving articles.

Containers are, of course, generally used to store and/or transport objects. However, particularly in the field of shaving articles, such containers must perform a variety of other functions. For example, it is frequently desirable to have a container which is useful to serve as a support for displaying an object which has been inserted into the container. Furthermore, it is also desirable to have easy access to a container which is mounted with a corresponding fastener attachment to a wall.

In order to facilitate the displaying function, particularly when the container is mounted on a wall, it is desirable to be able to move a pair of juxtaposed container sections relative to each other. If one of the container sections can be moved a sufficient distance, then the upper section can serve as a support for the lower section.

However, the prior art containers have not proven altogether satisfactory in displaying or granting ready access to the interior of a container, particularly when the container is mounted to a wall. The container sections only have limited movement relative to each other and are therefore not movable through a complete 360° revolution. Furthermore, the relatively limited movement of the prior art containers means that the opened container projects a rather large distance from the surface of the wall.

SUMMARY OF THE INVENTION

Accordingly, it is the general object of the present invention to overcome the disadvantages of the prior art.

An additional object of the present invention is to pivotably mount a pair of container sections for pivotal movement in a path relative to one another so that the sections are turnable through a full revolution.

Still another object of the present invention is to provide a container which, when mounted to a wall, projects a minimum distance from the surface thereof.

An additional object of the present invention is to retain the sections at any selected position relative to each other in their path of movement.

Another object of the present invention is to provide a container which is simple in construction and inexpensive in manufacture.

In keeping with these objects and others which will become apparent hereinafter, one feature of the invention resides in the mounting of a pair of spaced container sections to a hinge structure. Each of the container sections is pivotably mounted on the hinge structure so that it is turnable in a path through a full 360° revolution about a respective imaginary axis which extends generally in direction transversely of the path of movement. This feature permits the container sections to overcome the prior art drawback of only having a limited range of relative movement with respect to each other.

In order to prevent undesirable displacement of the sections relative to each other in directions other than in the desired path of movement, the sections are positively guided in the path by a plurality of spur gears which together constitute a rocker-type joint. The spur gears are arranged in groups on opposite sides of the container, and each group is constituted of two pairs of gears each of which is mounted on the sections and on the hinge structure, respectively. This feature permits the hinge joint to have rather small dimensions which correspond to the combined radii of the gears and thereby insures that the container will project a minimum distance from a wall which it is mounted on.

In accordance with yet another feature of the invention, it is advantageous to frictionally retain the sections at any selected position relative to each other in the path. For this purpose, a set of gear teeth is provided on at least one of the spur gears, each of these teeth being aligned in direction so as to extend transversely of the path. Another different set of gear teeth is provided on at least another one of the gears, each of these different set of teeth being inclined relative to the first-mentioned set of teeth so as to frictionally engage and retain the sections at any of a plurality of selected positions in the path.

It is particularly desirable if either one of the gears having the differently-oriented teeth is constituted of elastically-yieldable material. Thus, only a slight deformation of the elastically yieldable gear will occur so as to facilitate the frictional meshing engagement of the gears.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
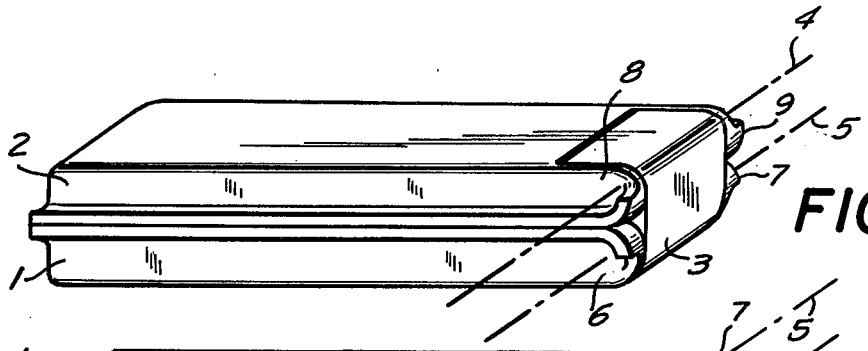
FIG. 1 is a perspective view of a container in a fully closed condition.
Figure 2:
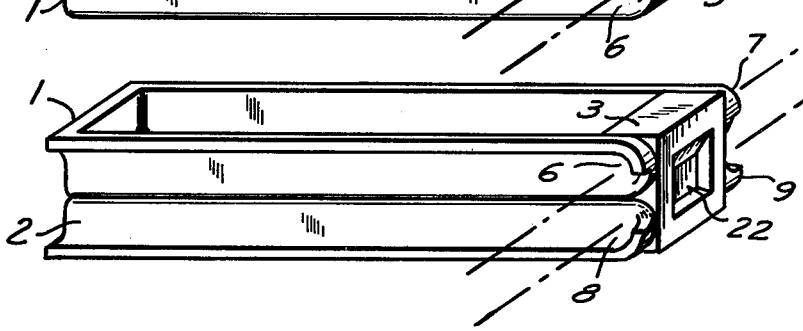
FIG. 2 is a perspective view of the container of FIG. 1 in a fully opened condition.

Referring firstly to FIG. 1, a preferred embodiment of the container is comprised of two spaced, elongated container sections 1, 2 which are interconnected by a hinge structure 3. Each of the sections 1, 2 is pivotably mounted on the hinge 3 so that each section is turnable in a path through a full 360° revolution about respective imaginary axes 4, 5 which extend generally in direction transversely of the path, i.e. transversely of the elongation of the sections. FIG. 1 shows the container in fully-closed condition; FIG. 2 shows the container in fully-opened condition.

In order to insure that the two sections 1, 2 properly mate with each other in either one of the end positions shown in FIGS. 1 or 2, it is desired to prevent each of the components of the so-called "three member system" from undesirably shifting relative to each other. Thus, in order to positively guide the section in the desired path of movement, motion-transmitting means are provided intermediate the hinge 3 and the sections 1, 2. As will be seen more clearly in FIGS. 3, 4 and 5, this motion-transmitting means comprises a rocker-type joint which is constituted of a plurality of spur gears 10–13 and 16–19.

Figure 3:
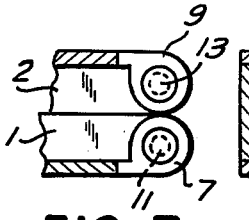
FIG. 3 is a partial vertical section of a detail of FIG. 1.
Figure 5:
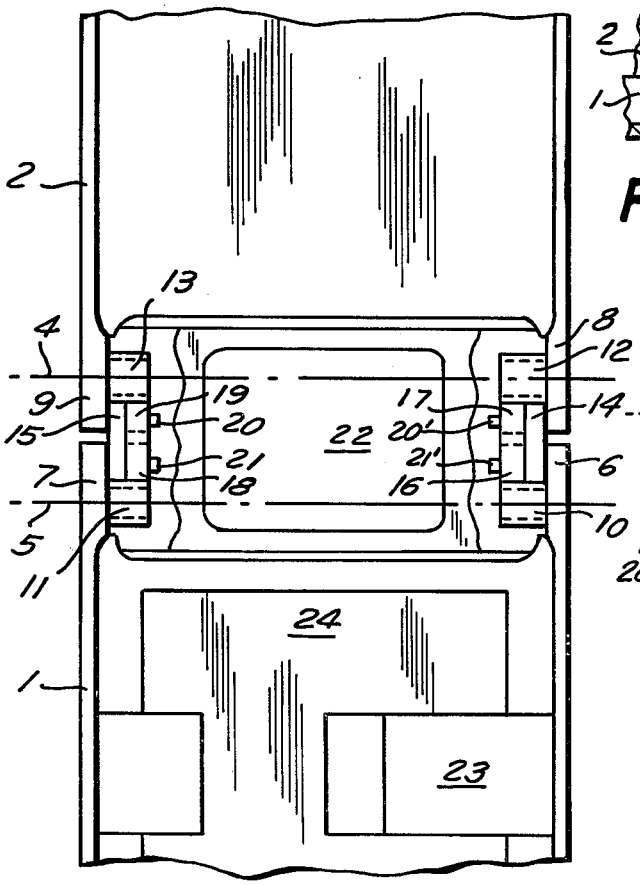
FIG. 5 is a top plan view of the container of FIG. 1 in half-opened condition showing the interior of the container.

Referring now to FIG. 5, each lateral side of the sections 1, 2 is formed with flanges. Section 1 is formed with flanges 6 and 7; section 2 is formed with flanges 8 and 9. At the inwardly-facing sides of flanges 6–9, a plurality of first gears 10–13 are mounted. FIG. 3 illustrates the mounting of first gears 11 and 13 on flanges 7 and 9 of sections 1 and 2.

Figure 4:
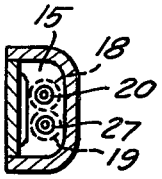
FIG. 4 is a partial vertical section of another detail of FIG. 1.

Similarly, each inwardly-facing side of lateral side walls 14, 15 of the hinge 3 is mounted with a plurality of second gears 16–19 for rotation about axes 21', 20', 21 and 20, respectively. FIG. 4 illustrates the mounting of second gears 18 and 19 on hinge 3. As will be noted from FIG. 5, the group of gears at the right side of the container are in meshing engagement with each other, i.e. gear 12 exteriorly contacts gear 17 which, in turn, exteriorly contacts gear 16, which, in turn, contacts gear 10. The same is true for the group of gears at the left side of the container. Thus, in operation, the sections 1, 2 are positively guided by the spur gears.

Figure 6:
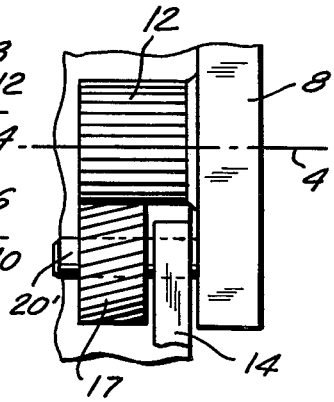
FIG. 6 is an enlarged view of a detail of FIG. 5.

In accordance with another feature of the invention, the sections 1, 2 may be retained and frictionally locked at any selected position relative to each other in the path. Thus, with reference to FIG. 6, a first set of gear teeth having its teeth aligned so as to extend transversely of the path may be provided on any one of the spur gears, for example, gear 12 is shown. A second set of gear teeth may be provided on any other one of the spur gears, for example gear 17, and this second set of gear teeth is inclined relative to the first-mentioned set so that frictional engagement will occur therewith. It will be appreciated that the inclination of the teeth of gear 17 relative to the teeth formed on gear 12 has been exaggerated for the sake of clarity. Furthermore, it is desirable if either one of the gears having the differently-oriented teeth is constituted of elastically-yieldable material, such as rubber or synthetic plastic material, so that the frictional meshing engagement can occur with only a slight deformation of the elastically-yieldable gear. With this feature, the sections 1, 2 are prevented from self-movement.

The container is especially useful in the storage of shaving articles, such as electric shavers and other analogous objects, although it will be appreciated that the container can be used to store any object. In this particular case, a storage recess 22 is formed in the interiorly facing wall of the hinge when the container is in its fully-closed condition.

In shaving applications, it is also desirable to mount a mirror 24 on the interior of one of the sections 1 or 2; moreover, a holding clamp 23 for holding shaving accessories may also be provided on either one of the sections 1, 2.

It will be understood that each of the elements described above, or two or more together, may also find a useful application in other types of structures differing from the types described above.

While the invention has been illustrated and described as embodied in a container for storing objects, it is not intended to be limited to the details shown, since various modifications and structural changes may be made without departing in any way from the spirit of the rpesent invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific objects of the present invention.

What is claimed as new and desired to be protected by Letters Patent is set forth in the appended claims:

1. An openable container comprising a pair of mating container sections each having two lateral sides; two pairs of first gears secured, respectively, to opposite end portions of said lateral sides to define a separate rotation axis for each section; a hinge member arranged between said end portions and surrounding said pairs of first gears; and two pairs of meshing second gears supported for rotation on said hinge member between said pairs of first gears, each of said second gears engaging an assigned first gear to support respective container sections for rotation about 360° about said separate axes.

2. The container of claim 1, each of said sections being rectangular with two longitudinally extending walls and two transversely extending walls connecting said longitudinally extending walls, each of said longitudinally extending walls having an end portion projecting outwardly past a respective one of said transversely extending walls.

3. The container of claim 2, each of said end portions including said first gear fixed to the inward side of the respective end portion and each pair of said first gears of each section being adapted to fit within said hinge member.

4. The container of claim 1, each of said first gears and second gears having teeth, the teeth of each second gear being inclined relative to the teeth of each first gear, and each of said first gears and second gears being formed of an elastic material.

5. The container of claim 4, each of said first gears having teeth aligned so as to extend parallel to said two pivot axes, and each of said second gears having teeth which mesh with and are inclined relative to the teeth of a respective one of said first gears.

* * * * *